US005210528A

United States Patent [19]

Schulman et al.

[11] Patent Number: 5,210,528

[45] Date of Patent: May 11, 1993

[54] AUDIBLE FLOOR MAT

[75] Inventors: David S. Schulman; Alan Z. Kessler, both of Kansas City, Mo.; Norman H. Heyder, Olathe; John Herndon, DeSoto, both of Kans.

[73] Assignee: DP Technologies, Inc., Kansas City, Mo.

[21] Appl. No.: 860,737

[22] Filed: Mar. 26, 1992

[51] Int. Cl.[5] ..... G08B 21/00; G08B 23/10

[52] U.S. Cl. ..... 340/666; 200/86 R; 340/692; 340/693

[58] Field of Search ..... 340/666, 692, 693; 200/86 R

[56] References Cited

U.S. PATENT DOCUMENTS

| | | | |
|---|---|---|---|
| Re. 28,365 | 3/1975 | Braue | 200/86 R |
| 2,783,327 | 2/1957 | Luckey | 200/86 R |
| 3,417,215 | 12/1968 | Corona et al. | 200/86 R |
| 4,497,989 | 2/1985 | Miller | 200/86 R |
| 4,551,713 | 11/1985 | Aossey | 340/666 |
| 4,744,015 | 5/1988 | Lai . | |

*Primary Examiner*—Glen P. Swann, III

*Attorney, Agent, or Firm*—Michael Yakimo, Jr.; D. A. N. Chase; Richard P. Stitt

[57] ABSTRACT

A floor mat includes a housing for containing a power supply, speech module and speaker. A grid-like switching mechanism is closed upon a person stepping on the mat so as to provide an energizing current flow to the speech module. The speech module includes circuitry for recording and playing back a selected message. A slidable or releasable panel in the housing allows for selectable user access to the speech module. The housing precludes weather deterioration of the elements therein and cooperates with the switching mechanism so as to provide a user-selectable message to a person stepping on the mat. The mat/housing configuration allows alternative switching mechanisms to be used in connection with replaceable speech modules.

12 Claims, 4 Drawing Sheets

Fig. 1
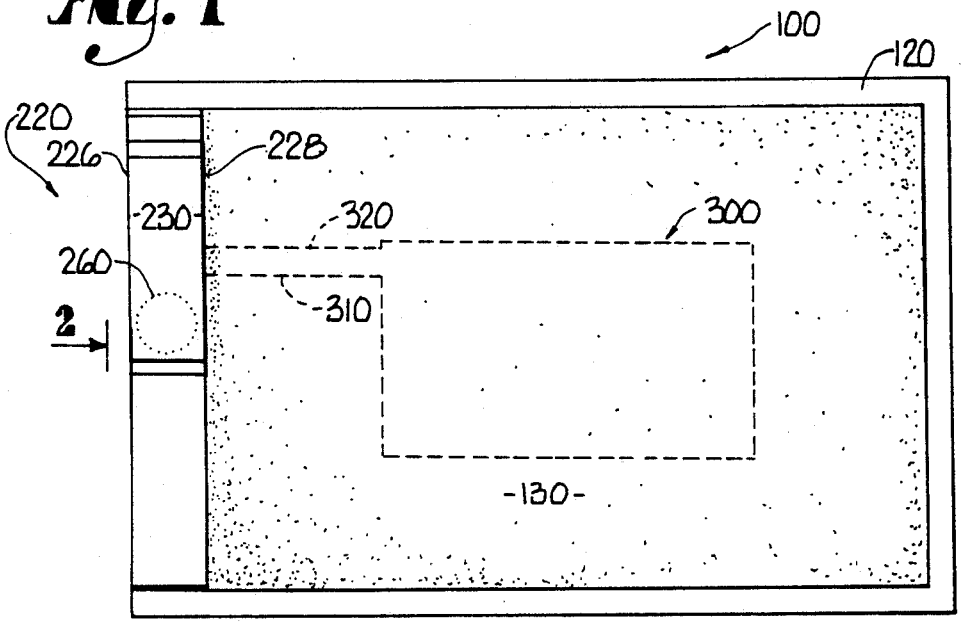
Fig. 2
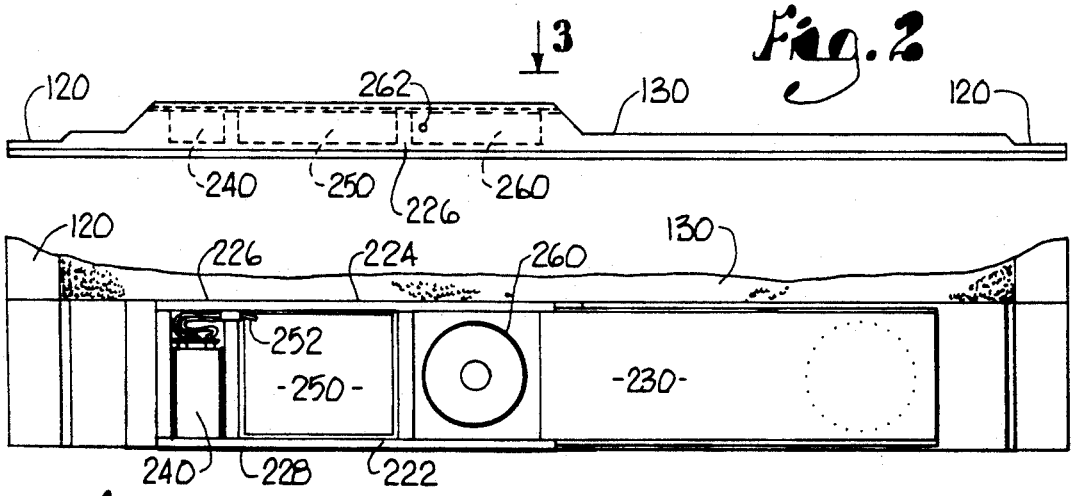
Fig. 3
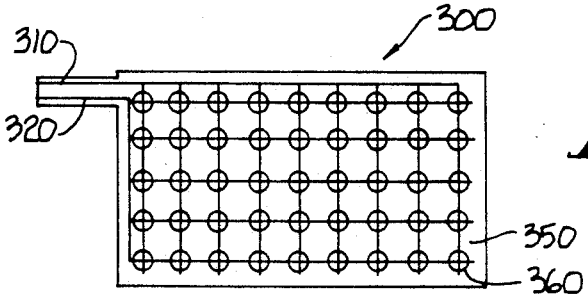
Fig. 4

AUDIBLE FLOOR MAT

BACKGROUND OF THE INVENTION

This invention relates to a floor mat device, and more particularly to a floor mat for performing an audible message upon a person stepping thereon.

The use of electrical switches incorporated into floor mats is known. Various uses for such floor mats have been suggested such as for energizing lights, bells etc. as well as opening doors. Heretofore, such floor mat devices were interfaced with an externally displaced device such as a light, alarm or door opening mechanism. The interface required a physical connection between the external element and the switching mechanism in the mat proper. This necessity not only increased the expense of the device but also introduced additional labor costs needed to establish the interface. Also, in some cases the design of the physical interface itself, usually in the form of a hard wire or other type of current relaying device, degraded the aesthetics of the surrounding environment such as the doorway, entrance or other area in which the floor mat was to be used. Finally, the past floor mats were usually relatively complex in construction particularly as to the incorporation of the switching element utilized therein. Thus, it is desirable to have a cost-effective floor mat which avoids the above problems and defects.

In response thereto, we have invented a floor mat device incorporating a speech module which allows the user to record his/her own selectable message for playback upon a person stepping on the floor mat proper. The module may be either programmed with a user-selectable message or may contain a preprogrammed message such as "welcome,""good morning," etc. The module is releasably insertable into a mat housing which precludes the need to interface the mat with any external device. A speaker jack may be provided by which the message may be relayed to a displaced location via an external audio transducer in addition to the speech module speaker. The device is activated by pressure responsive switch mechanisms (two disclosed) which are easily constructed and embedded in the floor mat proper with minimum time, trouble and expense.

Accordingly, it is a general object of this invention to provide a floor mat which plays back an audible message upon pressure being exerted thereon.

Another general object of this invention is to provide a floor mat, as aforesaid, which plays back an audible message upon a user stepping thereon.

A further object of this invention is to provide a floor mat, as aforesaid, by which playback of the audible message is controlled by a pressure responsive switch incorporated in the mat proper.

Another object of this invention is to provide a floor mat, as aforesaid, which has a housing thereon for containing a record and/or playback speech module with power supply and speaker therein.

A particular object of this invention is to provide a floor mat with housing, as aforesaid, which allows user access to the speech module therein, either in the form of a releasable or slidable housing panel.

Another particular object of this invention is to provide a floor mat with housing, as aforesaid, which protects the speech module from the weather.

A further particular object of this invention is to provide a floor mat with housing, as aforesaid, which allows various speech modules to be easily placed therein either from the top or underside of the housing.

Another object of this invention is to provide a floor mat with housing, as aforesaid, which allows the user to have a selectable access to the speech module so as to either record a message, replace the module or otherwise affect the speech module therein.

Still another object of this invention is to provide a floor mat with switch, as aforesaid, which is impervious to the weather.

A further object of this invention is to provide a floor mat, as aforesaid, which can play back either a user selectable or a pre-programmed message.

Still another object of this invention is to provide a floor mat, as aforesaid, which incorporates an activating switch of novel design for the speech module which is relatively simple to manufacture and easily incorporated into the floor mat proper.

Another object of this invention is to provide a floor mat with housing, as aforesaid, which reasonably protects the speech module from damage upon persons stepping thereon.

Other objects and advantages of this invention will become apparent from the following description taken in connection with the accompanying drawings, wherein is set forth by way of illustration and example, an embodiment of this invention.

BRIEF DESCRIPTION OF THE DRAWINGS

FIG. 2 is a side view, taken along line 2 in FIG. 1, showing the housing with speech module, power supply and speaker in phantom lines therein;

FIG. 3 is a fragmentary view, taken along line 3 in FIG. 2, illustrating the housing in an open position to expose the power supply, speech module and speaker therein;

FIG. 4 is a view illustrating the switch mechanism used in the embodiment of FIG. 1;

FIG. 7 is a schematic circuit diagram of a now preferred form of speech module utilized in the floor mat;

DESCRIPTION OF THE PREFERRED EMBODIMENT

Figure 1:
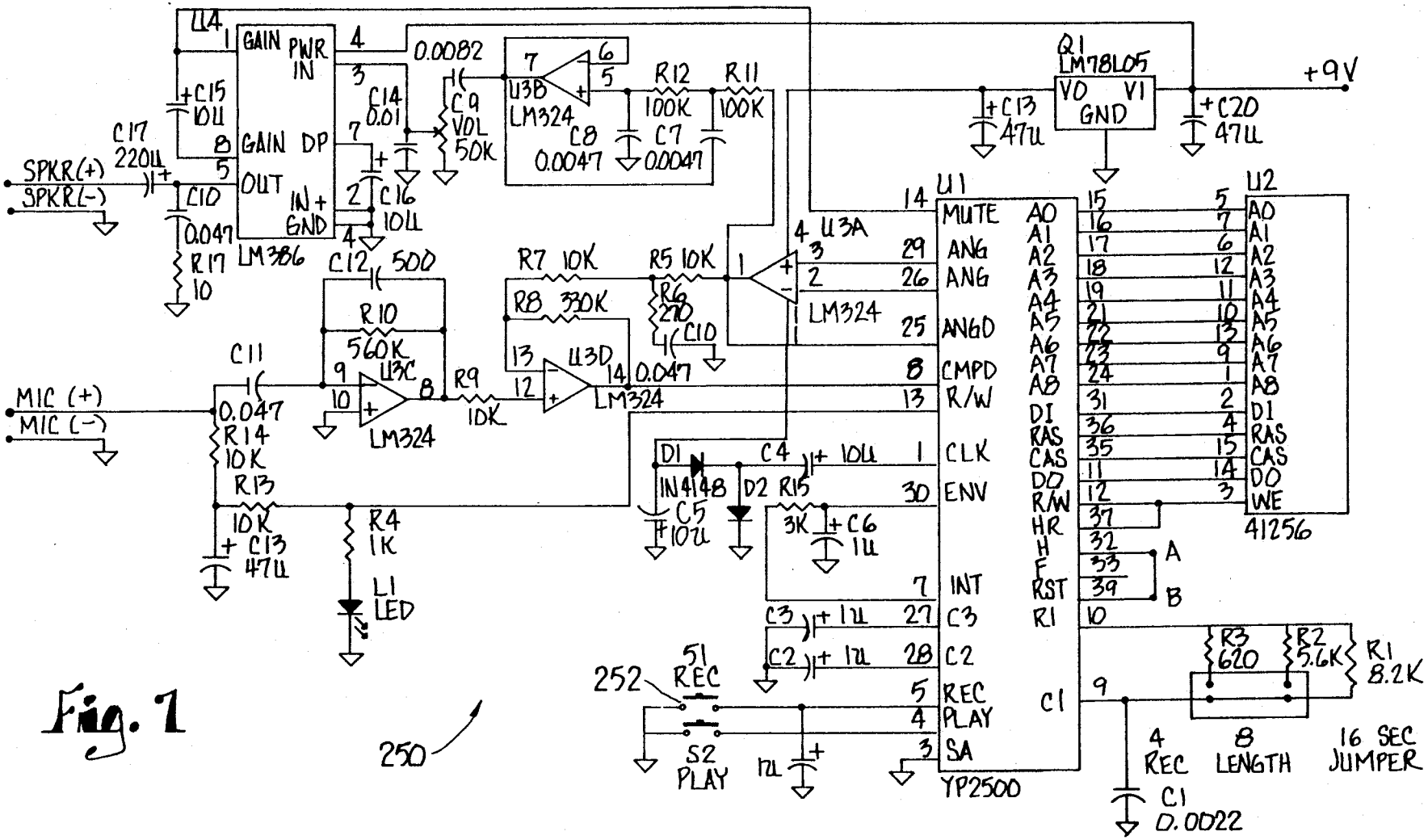
FIG. 1 is a plan view illustrating a first embodiment of the floor mat and showing in phantom lines thereon an outline of the electrical switch for activating the speech module.

Turning more particularly to the drawings, FIG. 1 shows a plan view of the floor mat 100. The mat 100 generally comprises a rectangular mat 120 having a raised carpet pile 130 thereon. Incorporated in the mat 120 is an electrical switch means 300, as shown in phantom lines in FIG. 1 and in FIGS. 4 and 5, and to be subsequently described.

At one corner of the mat 120, adjacent the carpet pile 130, is affixed a raised housing 220 made of a weather and pressure impervious plastic or the like. The housing 220 includes first and second spaced apart rails 222, 224 (FIG. 3) located atop a pair of laterally spaced apart side walls 226, 228. A panel 230 is configured to slidably fit within rails 222, 224 so as to expose a 9-volt DC, power supply 240, speech module 250 and speaker 260 therein (FIG. 3). Accordingly, selectable access to the speech module 250 is provided while protecting the elements in the housing from the weather and/or a person stepping thereon.

Figure 8:
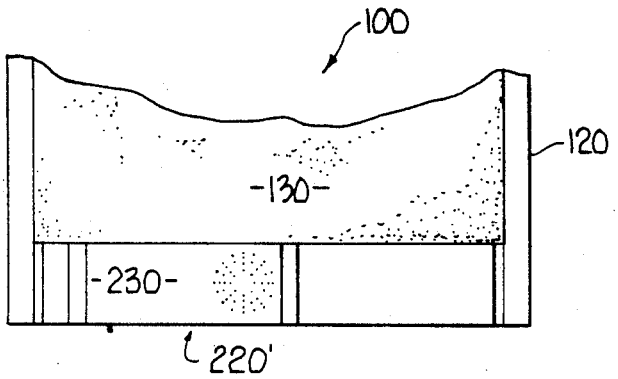
FIG. 8 is a top plan view showing an alternative housing for containing the speech module, power supply and speaker with the mat area being fragmentarily shown for purposes of illustration.
Figure 9:
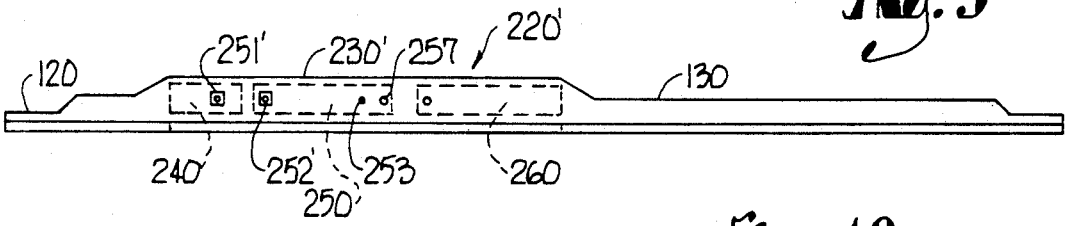
FIG. 9 is a side view of the housing shown in FIG. 8, on an enlarged scale, showing the housing with the speech module, power supply and speaker shown in phantom lines.
Figure 10:
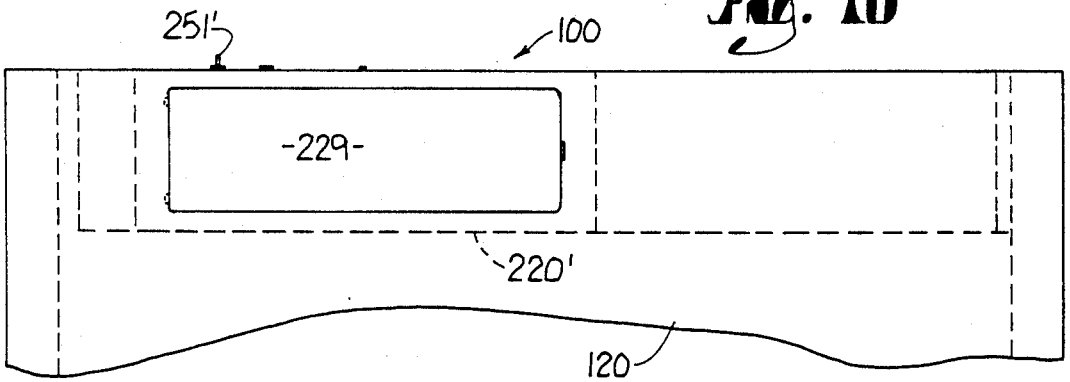
FIG. 10 is a bottom view of the housing to illustrate the access panel on the underside of the floor mat.

An alternative housing 220' is shown in FIGS. 8–10. In this embodiment the top wall 230° of the housing is fixed. Access to housing 220° is provided by a back panel 229 on the underside of the mat 120.

In construction, the reverse side of the carpet pile 130 is exposed and placed within a rectangular mold for pouring a thin layer of plastic thereon. The switching mechanism 300 or 400 can then be placed atop this first poured layer. Upon pouring a subsequent layer of plastic material thereon the layers are allowed to set so as to embed the switch mechanism 300 or 400 therein. Wire leads 310, 320 or 410 extending from the switch mechanism 300, 400 are then connected to the electrical circuitry (FIG. 7) of the speech module 250.

In construction of the FIG. 8 embodiment an aperture is die cut into the plastic material of the mat 120. The housing 220' is then fixed within the die cut aperture by a suitable adhesive material.

One form of speech module 250 is the Eletech DM-2500 speech module available from Electech Electronics of Anaheim, Ca. This module is a record and playback speech system with an on-board miniature microphone. The circuitry of such module 250, as provided by Eletech, is shown in FIG. 7.

Upon sliding the panel 230 along rails 222, 224 to the open (FIG. 3) position and toggling the record button 252, four, eight or 16 second speeches may be recorded by the user for subsequent playback. A 9-volt DC battery 240 provides a power supply 240 for the speech module 250 circuitry. The speech module 250, approximately 2.5 inches by 3 inches, is releasably insertable into the housing 220 along with the power supply 240 and speaker 260. The above-described record/playback module 250 may be fixed within housing 220 or it may be interchangeable with a module having a fixed prerecorded message with no record capability. The leads 310, 320, 410, 420 of the normally open switch 300, 400 are wired into the circuitry of either speech module such that switch closure will cause a current flow through the circuitry and activate the playback mode of the utilized speech module 250.

In the FIG. 8 embodiment the toggle switch 251' activates the power supply 240. Upon pressing the record switch 252' the user speaks into the microphone 257. An LED light 253 indicates whether the message is being recorded.

Figure 5:
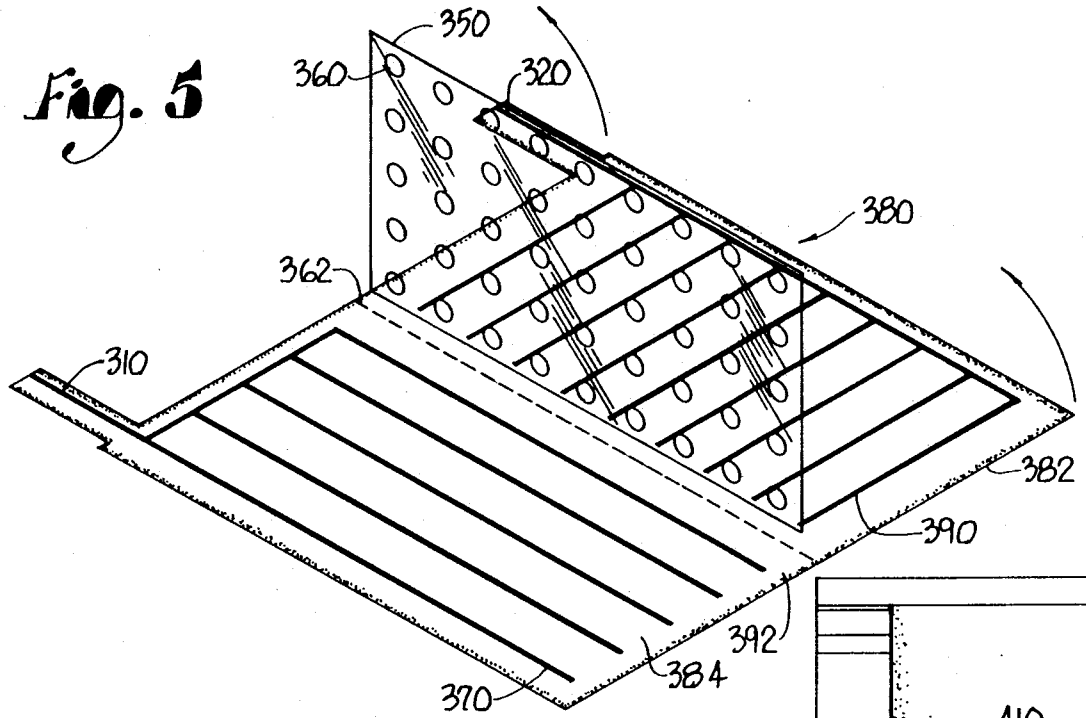
FIG. 5 is a semi-exploded view of the switch mechanism shown in FIG. 4, on an enlarged scale, illustrating the construction of the switch mechanism.

One switch 300 which may be utilized and incorporated into the mat is shown in FIGS. 4 and 5. Therein is shown a sheet of mylar 350 having a plurality of apertures 360 aligned in rows and columns therein. A single sheet 380 of plastic presents first and second panels 382, 384. Conductive ink material in the form of parallel strips are imprinted on each panel 382, 384. A plurality of parallel strips 370 are provided on panel 384 as well as a plurality of parallel strips 390 on panel 382 which are normal to panel 384 strips 370. A strip of adhesive 392 runs along the border of sheet 380. Accordingly, upon folding the panel 380 along its center line 362, closure of the same is accomplished by the mating of the facing portions of the adhesive strip 392. Upon such mating a plurality of spaced intersections of the strips 370, 390 will occur as displaced by the intermediate mylar 350. Leads 310, 320 are then connected to the circuitry of the speech modules 250. At this juncture the spatial relationship between the conductive strips 350, 370 presents a DC open precluding any current flow through the speech module 250 circuitry.

Upon pressure being exerted on the mat 100, e.g. by a person stepping thereon, the overlying strips 390 approach the underlying strips 370. The intermediate apertures 360 allow for contact of these strips 350, 370. Upon such contract, a closed current path is provided. Thus, current will flow causing playback of the previously recorded message on the speech module 250.

Figure 6:
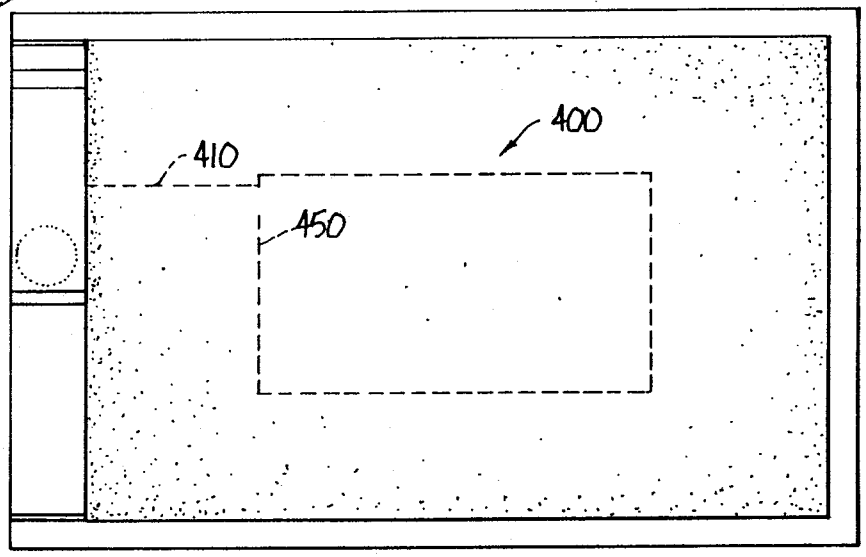
FIG. 6 is an alternative second embodiment of the floor mat showing the alternative activating switch mechanism.

Alternatively, a capacitor-type switch in the form of a 22-gauge wire 400 communicating with the circuitry of the speech module through lead 410 can be used as shown in FIG. 6. One end 450 of the 22-gauge wire is left open. This arrangement presents a capacitance-type switch. Upon a user stepping on the mat 100 a change in capacitance will occur causing a change in the voltage. This voltage change will cause a current flow through the speech module 250 so as to energize the same and play back the message.

Also, as shown in FIG. 3, a speaker jack 262 is associated with speaker 260 for connection of a wire thereto from an external audio device. This jack allows for wire communication between the speech module message and a source other than the speaker 260.

Accordingly, it is apparent that the use of the switches 300 or 400 with the housing 220 or 220' encompassing the speech module 250, speaker 260 and power supply 240 eliminates the above-described problems found in the prior art. The mat 100, as above described, precludes the need for an external, unsightly interface between the switch 300 or 400 in the mat and an external device. As such, unsightly wiring or the like is eliminated which enhances the aesthetics of the surrounding environment and precludes the need for any additional installation costs. Moreover, as the speech module is enclosed in the housing 220 by either the slidable panel 230 or releasable back panel 229, easy access is made available to the housing 220, 220' upon selectable panel 229, 230 manipulation in order to change the recorded message or the entire module 250 itself. Also, the housings 220, 220' render the assembly reasonably impervious to weather so as to increase its life. Finally, the possibility of destruction of the contents of the housings 220, 220' by a person stepping on the mat is reasonably precluded.

The use of the housing 220' with panel 229 on the underside of the mat 120 further decreases the possibility of weather and pressure damage to the contents therein. Moreover, this housing 220' discourages undesirable access thereto due to the position of the releasable panel 229.

It is to be understood that while three forms of this invention have been illustrated and described, it is not limited thereto, except insofar as such limitations are included in the following claims and allowable functional equivalents thereof.

Having thus described the invention what is claimed as new and desired to be secured by Letters Patent is as follows:

1. A floor mat comprising:
a mat for placement on a support surface;
a speech module assembly including electrical circuitry for recording and playback of a selected message;
a power source for said circuitry;
a housing on said mat for said speech module;
a speaker in said housing and in communication with said speech module;
a slidable panel in said housing, said panel slidable in a first direction for allowing a user access to said speech module and a second direction for closing said housing;
switch means in said mat for causing a current flow through said speech module upon an exertion of pressure on said mat, whereupon to play back the selected message.

2. The device as claimed in claim 1 wherein said switch means comprises:
a generally rectangular panel having first and second portions;
a plurality of elongated parallel strips of a conductive material in said first panel;
a plurality of elongated parallel strips of a conductive material in said second panel, said first panel strips normal to said second panel strips;
a third panel intermediate said first and second panels;
a plurality of apertures in said third panel, whereupon said apertures allowing for at least one of said first panel strips to contact an underlying second panel strip upon a pressure being exerted on said mat, said contact allowing for a current flow through said switch;
means for connecting said switch with said speech module.

3. The device as claimed in claim 2 wherein said switch means is embedded in said mat.

4. The device as claimed in claim 1 wherein said switch means comprises:
a wire loop;
means for connecting said loop with a power supply of said speech module, said loop presenting a capacitance-type switch whereupon a exertion of pressure on said map causes a voltage change in said switch, said voltage change causing a current flow through said speech module.

5. The device as claimed in claim 4 wherein said loop follows a perimeter of said mat.

6. The device as claimed in claim 4 wherein said loop is embedded in said mat.

7. The device as claimed in claim 1 further comprising:
a jack in communication with said speaker for communicating the speech module with an external audio transducer.

8. The device as claimed in claim 1 wherein said housing comprises:
a compartment having at least first and second opposed side walls for encompassing said module;
a rail at a top of each side wall to present a track, said panel having structure for engaging said track for slidable movement in a first direction to open said compartment and expose said speech module therein and a second opposed direction to close said compartment and cover said speech module.

9. In a floor mat having a normally open pressure-responsive switch for energizing an electrical device upon pressure being exerted on said mat, the improvement comprising:
a housing on said mat;
a speech module comprising said device and having an associated power supply and speaker in said housing;
a slidable panel in said housing, said panel slidable in a first direction to allow a user access to said housing and second direction for closing said housing, whereupon said panel allows said user access to said speech module.

10. In a floor mat having a normally open pressure-responsive switch for energizing an electrical device upon pressure being exerted on said mat, the improvement comprising:
a housing on said mat;
a speech module comprising said device and having an associated power supply and speaker in said housing;
a releasable panel in said housing, said panel allowing for a user access to said housing and said speech module therein.

11. The device as claimed in claim 10 wherein said releasable panel is on the bottom of said housing.

12. A floor mat comprising:
a mat for placement on a support surface;
a speech module assembly including electrical circuitry for recording and payback of a selected passage;
a power source for said circuitry;
a housing associated with said mat for containing said speech module assembly;
a speaker in said housing and in communication with said speech module;
switch means in said mat for causing a current flow through siad speech module upon an exertion of pressure on said mat, whereupon to play back the selected message.

* * * * *

UNITED STATES PATENT AND TRADEMARK OFFICE

CERTIFICATE OF CORRECTION

PATENT NO. : 5,210,528

DATED : May 11, 1993

INVENTOR(S) : DAVID S. SCHULMAN ET AL

It is certified that error appears in the above-identified patent and that said Letters Patent is hereby corrected as shown below:

Column 1, line 35, delete "preprogrammed" and substitute --pre-programmed--.

Column 3, line 9, after the word "DC" delete the comma.

Column 3, line 15, delete "230°" and substitute --230'--.

Column 3, line 16, delete "220°" and substitute --220'--.

Column 3, line 34, delete "Electech" and substitute --Eletech--.

Column 6, line 46,delete "passage;" and substitute --message;--

Signed and Sealed this

Eighth Day of February, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,210,528

DATED : May 11, 1993

INVENTOR(S) : DAVID S. SCHULMAN ET AL

It is certified that error appears in the above-indentified patent and that said Letters Patent is hereby corrected as shown below:

Column 5, line 46, delete "a power supply"

Column 5, line 47, delete "of"

Column 6, lines 3-4, delete "communicating" and substitute --connecting--

Signed and Sealed this

Thirty-first Day of May, 1994

Bruce Lehman

*Attest:*

BRUCE LEHMAN

*Attesting Officer*

*Commissioner of Patents and Trademarks*